US008951216B2

(12) United States Patent
Yoo et al.

(10) Patent No.: US 8,951,216 B2
(45) Date of Patent: Feb. 10, 2015

(54) SKIN MASSAGER

(75) Inventors: Chang Gyu Yoo, Yongin (KR); Ju Ho Kim, Anyang (KR); Taek Keun Hong, Seoul (KR)

(73) Assignee: Amorepacific Corporation, Seoul (KR)

( * ) Notice: Subject to any disclaimer, the term of this patent is extended or adjusted under 35 U.S.C. 154(b) by 510 days.

(21) Appl. No.: 13/001,622

(22) PCT Filed: Jun. 25, 2009

(86) PCT No.: PCT/KR2009/003422

§ 371 (c)(1),
(2), (4) Date: Dec. 27, 2010

(87) PCT Pub. No.: WO2010/002135

PCT Pub. Date: Jan. 7, 2010

(65) Prior Publication Data

US 2011/0118638 A1 May 19, 2011

(30) Foreign Application Priority Data

Jun. 30, 2008 (KR) ..... 20-2008-0008738 U

(51) Int. Cl.
*A61H 7/00* (2006.01)
*A61H 23/02* (2006.01)

(52) U.S. Cl.
CPC ..... *A61H 7/005* (2013.01); *A61H 23/0254* (2013.01); *A61H 2201/0153* (2013.01); *A61H 2201/1418* (2013.01); *A61H 2201/1669* (2013.01)
USPC ..... 601/101; 601/84; 601/97; 601/107; 601/108

(58) Field of Classification Search
CPC ..... A61H 2201/1207; A61H 2201/1215; A61H 2201/123; A61H 2201/14; A61H 2201/1481; A61H 2201/149
USPC ..... 601/17, 18, 46, 48, 51, 67, 69, 70, 80, 601/81, 82, 84, 93, 97, 107, 111, 72, 73, 89, 601/92, 101, 103, 108, 109, 134, 135, 136, 601/137, 95, 53, 54, 104, 138; 30/392–394
See application file for complete search history.

(56) References Cited

U.S. PATENT DOCUMENTS 1,512,781 A * 10/1924 Masland ..... 30/392
2,267,138 A * 12/1941 Scardamalia ..... 601/89
3,596,525 A * 8/1971 Niesz ..... 74/57

(Continued)

FOREIGN PATENT DOCUMENTS

GB 2120099 A * 11/1983

*Primary Examiner* — Justine Yu
*Assistant Examiner* — LaToya M Louis
(74) *Attorney, Agent, or Firm* — Maxon IP, LLC; Justin H. Kim

(57) ABSTRACT

Disclosed is a skin massage device, the proposed idea capable of a skin massage device of scrubbing a skin applied with a massage cream, then giving physical stimulus on the skin at a massage thus helping the relaxation of muscles and activating metabolism to serve an elastic, healthy skin, characterized in that an operation device 15 to reciprocally translate a beating member 21 back and forth is installed at a rotating shaft 14 of a drive motor 15 to which an electric energy of a battery 100 is selectively supplied/blocked according to change of on/off of a rotary switch 12, comprised of the beating member 21 inflicting physical stimulus while interworking with the operation device 15.

1 Claim, 6 Drawing Sheets

(56) References Cited

U.S. PATENT DOCUMENTS

| | | | | |
|---|---|---|---|---|
| 3,968,789 | A * | 7/1976 | Simoncini | 601/95 |
| 3,978,851 | A * | 9/1976 | Sobel | 601/95 |
| 5,099,705 | A * | 3/1992 | Dravnieks | 74/50 |
| 5,269,767 | A * | 12/1993 | Wilk et al. | 606/204.25 |
| 5,447,491 | A * | 9/1995 | Bellandi | 601/112 |
| 5,951,501 | A * | 9/1999 | Griner | 601/108 |
| 6,190,339 | B1 * | 2/2001 | Imazaike et al. | 601/133 |
| 6,361,550 | B2 * | 3/2002 | Grey et al. | 606/204 |
| 6,454,732 | B1 * | 9/2002 | Lee | 601/101 |
| 6,599,260 | B2 * | 7/2003 | Tucek et al. | 601/107 |
| 6,616,621 | B1 * | 9/2003 | Kohr | 601/72 |
| 7,665,216 | B2 * | 2/2010 | Yasheng | 30/392 |
| 7,818,887 | B2 * | 10/2010 | Saegesser et al. | 30/392 |
| 8,096,963 | B2 * | 1/2012 | Murugan et al. | 601/97 |
| 8,206,328 | B2 * | 6/2012 | Adamson | 601/133 |
| 2003/0018284 | A1 * | 1/2003 | Lim | 601/98 |
| 2005/0148906 | A1 * | 7/2005 | Skover et al. | 601/17 |
| 2005/0187496 | A1 * | 8/2005 | Ho | 601/15 |
| 2007/0150004 | A1 * | 6/2007 | Colloca et al. | 606/238 |
| 2007/0203436 | A1 * | 8/2007 | Kamimura et al. | 601/97 |
| 2008/0025785 | A1 * | 1/2008 | Ma et al. | 401/87 |
| 2008/0209742 | A1 * | 9/2008 | Kretschmar et al. | 30/392 |
| 2009/0246048 | A1 * | 10/2009 | Kawasaki et al. | 417/423.4 |

* cited by examiner

SKIN MASSAGER

CROSS-REFERENCE TO RELATED APPLICATIONS

This application claims priority from Korean Utility Model Application No. 20-2008-0008378, filed on Jun. 30, 2008 in the Korean Intellectual Property Office, the entire disclosure of which is incorporated herein by reference.

TECHNICAL FIELD

The present invention relates to a skin massage apparatus which applies physical stimuli to skin to help muscles be relaxed and to activate metabolism, thereby maintaining the skin elastic and healthy, and more particularly, to a skin message apparatus which converts a rotational motion of a drive motor to a linear motion to tap skin with a massage plate including acupressure bosses, thereby applying physical stimuli to the skin so that the physical stimuli help muscles be relaxed and activate metabolism, while maintaining the skin elastic and healthy.

RELATED ART

In general, when skin is exposed to ultraviolet light, dead skin cells grow so thick that transparency and metabolism of the skin are lowered and moisture and nutrients fail to be smoothly supplied at the same time.

Due to this, skin care through massage is used as a means for preventing accelerated aging of the skin.

The skin care methods are largely classified into a method of applying functional cosmetics to skin to massage the skin, and a method of applying physical stimuli to massage the skin.

In the case of applying the functional cosmetics to skin, the moisture of the skin is maintained to prevent accelerated aging of the skin, and moisture maintenance is one of the absolutely necessary factors for maintaining the skin elastic. Further, when the moisture maintenance function is lowered, the skin loses elasticity to become crumble and is wrinkled due to sagging.

Thus, functional cosmetics are applied to the skin to supply nutrients to the skin, and moisturizer is applied to the skin to maintain the skin moist at the same time.

As described above, when the skin is massaged by applying the functional cosmetics to the skin, fingers of a human are chiefly used, but in the case where the skin is massaged while being rubbed by the fingers, the physical stimuli are not applied to the skin such that only the massage effect from the functional cosmetics is expected.

Accordingly, the effect can be doubled by using the skin massage apparatus which applies the physical stimuli to the skin to which the functional cosmetics is applied without rubbing the skin with the fingers to help the muscles be relaxed and to activate the metabolism, thereby maintaining the skin elastic and healthy.

The existing skin massage apparatus configured to apply the physical stimuli to the skin as described above is largely classified into a manual type and a motor-driven type.

Of the types classified as described above, the motor-driven skin massage apparatus which can be safely used without making an effort is now being widely used The motor-driven skin massage apparatus is configured such that a massage unit taps the skin while reciprocating forward and rearward.

However, the massage unit taps the skin as described above such that a dermis layer and a subcutaneous tissue layer organizing the skin are also stimulated, thereby achieving improved massage effects as compared with the case where the skin is massaged, with the skin being rubbed by hands, whereas since the massage unit of the skin massage apparatus is directly connected to a driving motor so that forward and rearward reciprocation of the massage unit is performed by electric power of the motor, when the massage unit is excessively attached to the skin and an overload is generated, the overload is directly applied to the driving motor to frequently generate motor failures causing a functional loss of the skin massage apparatus, causing negative recognition for the products in consumers and also causing difficulties in securing market competitiveness.

SUMMARY OF THE INVENTION

Problem to be Solved

The present invention has been made to solve the disadvantages of the prior art, and provides a skin massage apparatus in which a forward and backward actuating unit of a tapping member of the skin massage apparatus is improved to minimize an overload occurring in a driving motor by effectively applying physical stimuli to skin when the skin to which a massage cream is applied is rubbed and massaged to help muscles be relaxed and to activate metabolism, thereby maintaining the skin elastic and healthy, so that distrust of consumers caused by a failure of the driving motor is solved, use of the skin massage apparatus at home is boosted by securing reliability of the skin massage apparatus such that the problem of having to care the skin in a special beauty shop is solved, the number of drops by special beauty shops is reduced such that there is an expected effect of lessening an economic burden, and skin care is enabled by using a free time without spending a separate time, which meets the requirements of the consumers.

In accordance with an aspect of the present invention, there is provided A skin massage apparatus which applies physical stimuli to skin to help a muscle be relaxed and to activate metabolism, thereby maintaining the skin elastic and healthy, wherein an actuating unit for reciprocating forward and rearward a tapping member is installed in a rotary shaft of a driving motor where electrical energy supply of a battery is selectively interrupted in response to on/off conversion of a rotary switch, and the tapping member is operated conjunction with the actuating unit to apply physical stimuli to the skin.

Effect of the Invention

According to the present invention, a forward and backward actuating unit of a tapping member of the skin massage apparatus is improved to minimize an overload occurring in a driving motor by effectively applying physical stimuli to skin when the skin to which a massage cream is applied is rubbed and massaged to help muscles be relaxed and to activate metabolism, thereby maintaining the skin elastic and healthy, so that distrust of consumers caused by a failure of the driving motor is solved, use of the skin massage apparatus at home is boosted by securing reliability of the skin massage apparatus such that the problem of having to care the skin in a special beauty shop is solved, the number of drops by special beauty shops is reduced such that there is an expected effect of lessening an economic burden, and skin care is enabled by using a free time without spending a separate time, which meets the requirements of the consumers.

BRIEF DESCRIPTION OF THE ACCOMPANYING DRAWINGS

DETAILED DESCRIPTION

Figure 1:
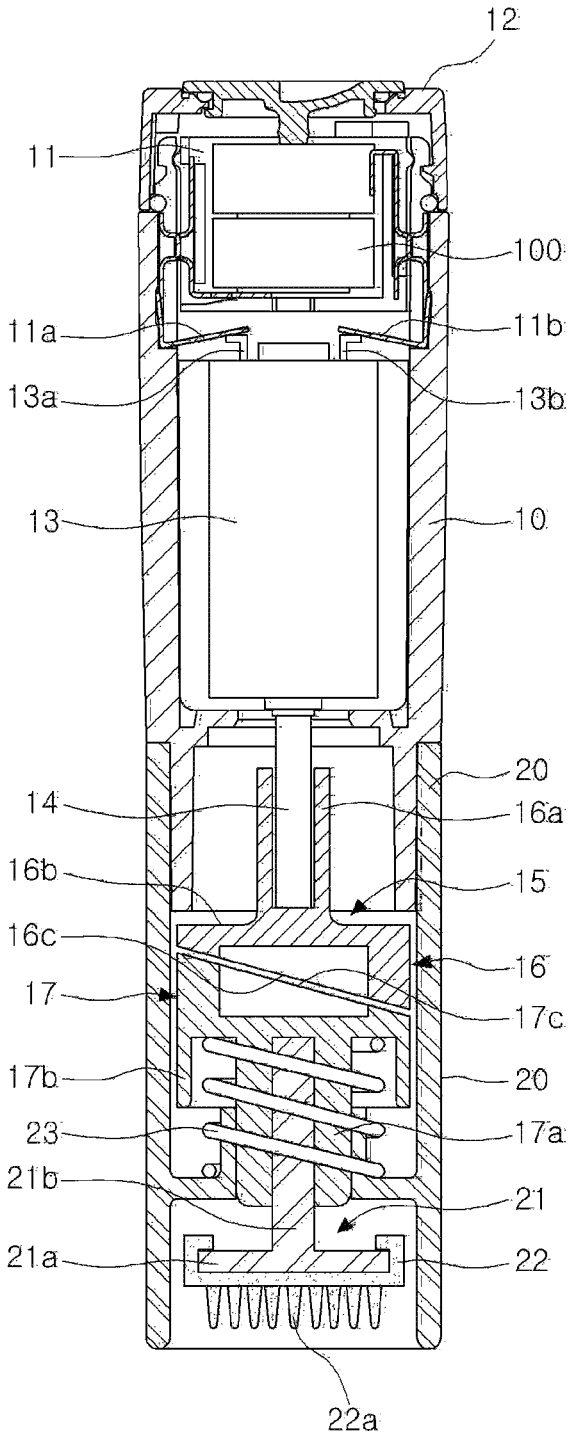
FIG. 1 is a schematic sectional view showing an exemplary embodiment of the present invention.
Figure 2:
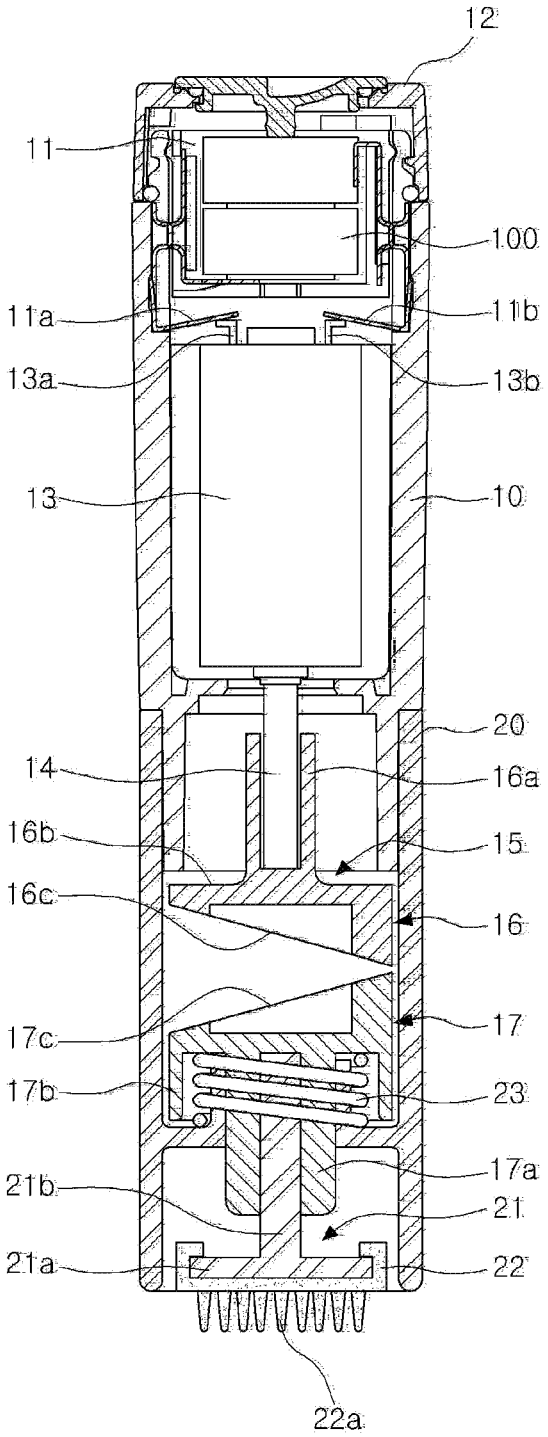
FIG. 2 is an exemplary view showing a state where a tapping member is operated by an actuating unit in a state of FIG. 1.

Hereinafter, exemplary embodiments of the present invention will be described in more detail with reference to the accompanying drawings.

As shown in FIGS. 1 to 10, an skin massage apparatus of the present invention includes a first case 10 in which a battery receiving unit 11 in which batteries 100 are received, a driving motor 13, and an actuating unit 15 operated by the driving motor 13 are installed, and a second case in which a tapping member 21 operated in conjunction with the actuating unit 15 is installed.

Positive and negative electrical connection pieces 11*a* and 11*b* electrically connected to positive and negative electrodes of the received batteries 100, respectively, to supply electrical energy of the batteries 100 to the driving motor 13, and a rotary switch 12 configured to selectively supply the electrical energy of the batteries 100 are installed in the battery receiving unit 11 of the case 10.

The driving motor 13 is installed adjacent to the positive and negative electrical connection pieces 11*a* and 11*b* which are electrically connected to positive and negative electrical connection terminals 13*a* and 13*b* thereof, respectively.

The actuating unit 15 operated by the driving motor 13 is installed on a side opposite to the battery receiving unit 11.

The actuating unit 15 includes a driving member 16 connected to a rotary shaft 14 of the driving motor 13, and a driven member 17 operated in conjunction with the driving member 16.

The driven member 17 is installed within the second case 20 such that a repulsive resilient force of a spring 23 is applied thereto, and the tapping member 21 is installed in the driven member 17.

The driving member 16 is keyed to the rotary shaft 14 of the driving motor 13 through a connector 16*a*, and includes a disk cam 16*b* having an inclined surface 16*c* one side of which is low and an opposite side of which is high. The driven member 17 includes a disk cam 17*b* having an inclined surface 17*c* which corresponds to, and faces to make surface-contact with the inclined surface of the disk cam 16*b* of the driving member 16, and a connecting pipe 17*a* formed at a lower portion of the disk cam 17*b* such that a connecting rod 21*b* formed on a head mounting disk 21*a* of the tapping member 21 is connected thereto.

A repulsive spring 23 which applies a resilient repulsive force to the disk cam 17*b* such that the disk cam 17*b* can reciprocate is installed on an outer side of the connecting pipe 17*a* of the disk cam 17*b*.

The tapping member 21 installed in the driven member 17 of the actuating unit 115 located within the second case 20 includes the connecting rod 21*b* inserted into the connecting pipe 17*a* of the driven member 17, and a tapping head 22 on which a plurality of stimulus bosses 22*a* are irregularly arranged is assembled with the head installation disk 21*a* formed at an end portion of the connecting rod 21*b*.

The tapping head 22 is injection-molded of a rubber material.

A driving member 16 of the actuating unit 15 according to another embodiment of the present invention includes a driving bevel gear 16*d* installed in the driving motor 13, a driven bevel gear 16*e* engaged with and operated in conjunction with the driving bevel gear 16*d*, and a cam 16*f* installed on the same shaft to be operated in conjunction with the driven bevel gear 16*e*, and a driven member 17 which contacts the cam 16*f* of the driving member 16 to move forward and rearward has a connecting pipe 17*a* to which the connecting rod 21*b* of the tapping member 21 is coupled, and is installed to bear the repulsive force of the repulsive spring 23 to be restored after moving forward.

A driving member 16 of the actuating unit 15 according to another embodiment of the present invention includes a driving bevel gear 16*d* installed in the driving motor 13, a driven bevel gear 16*e* engaged with and operated in conjunction with the driving bevel gear 16*d*, a cam 16*f* installed on the same shaft to be operated in conjunction with the driven bevel gear 16*e*, and a crank rod 18 one end of which is hingedly connected to the cam 16*f* of the driving member 16 and an opposite end of which is hingedly connected to the connecting rod 21*b* of the tapping member 21.

Figure 7:
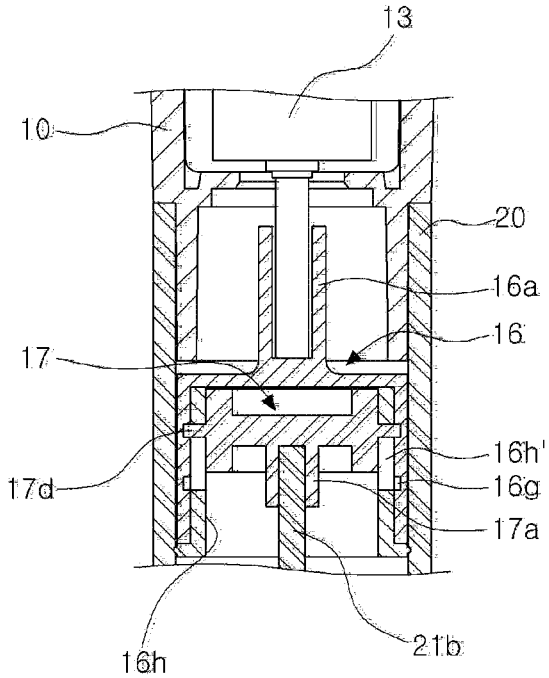
FIG. 7 is a schematic sectional view showing another exemplary embodiment of the present invention.
Figure 8:
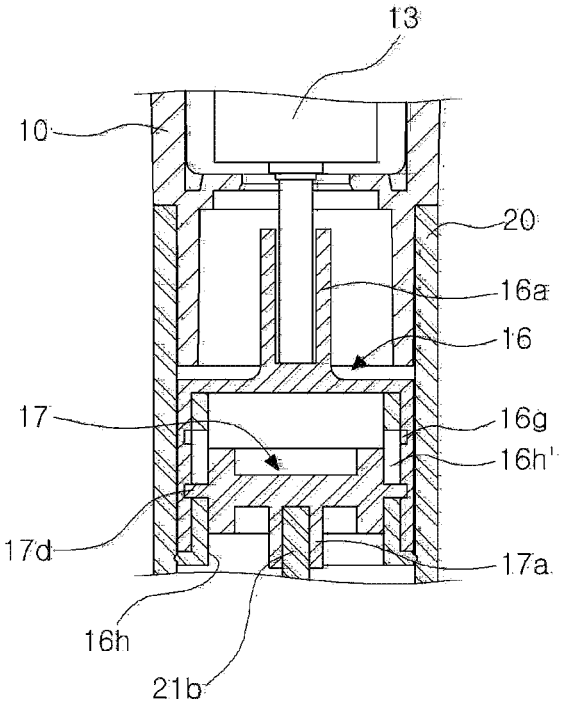
FIG. 8 is an exemplary view showing a state where a tapping member is operated by an actuating unit in a state of FIG. 7.

A rotating member 16 of the actuating unit 15 according to another embodiment of the present invention shown in FIGS. 7-8 is installed to be fixed to the second case 20 such that a connector 16*a* is keyed to the driving motor 13, a spiral groove 16*g* for guiding a guide protrusion 17*d* of the reciprocating member 17 is formed on an inner peripheral surface thereof, and a vertical guide 16*h* having a vertical guide hole 16*h*' such that the reciprocating member 17 reciprocates forward and rearward without being rotated is located therein.

The reciprocating member 17 operated in conjunction with the rotating member 16 has the guide protrusion 17*d* formed to face each other on an outer peripheral surface thereof, such that the guide protrusion 17*d* pass through the vertical guide hole 16*h*' of the vertical guide 16*h* and tip ends thereof are located in the spiral groove 16*g* of the rotating member 16, and a connecting pipe 17*a* to which the connecting rod 21*b* of the tapping member 21 is connected.

Figure 9:
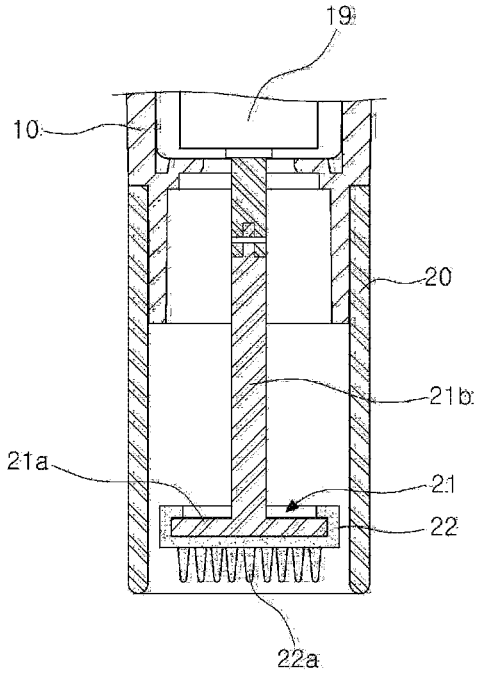
FIG. 9 is a schematic sectional view showing another exemplary embodiment of the present invention.
Figure 10:
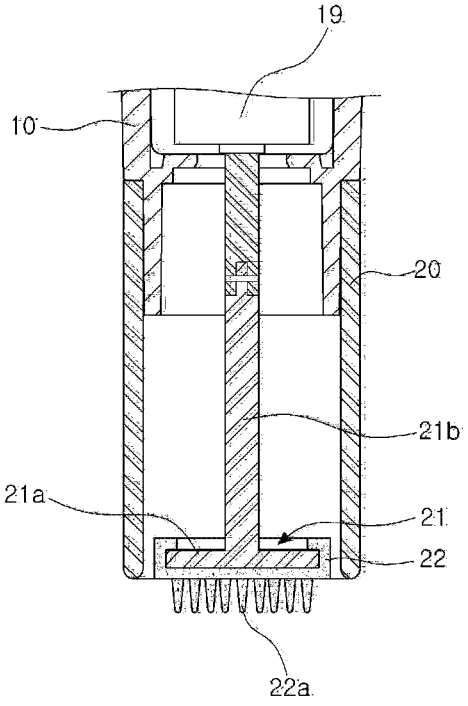
FIG. 10 is an exemplary view showing a state where a tapping member is operated by an actuating unit in a state of FIG. 9.

Another embodiment of the present invention shown in FIGS. 9 and 10 may be configured such that a connecting rod 21*b* of the tapping member 21 is directly connected to a piston rod of a solenoid 19 to move forward and rearward.

When skin is massaged by the skin massage apparatus of the present invention including the above-described configuration, a massage cream is first applied to a portion of the skin to be massaged to make the skin moist, and then the skin is tapped by the skin massage apparatus, which doubles the massaging effect.

When the skin is tapped to be massaged by the skin massage apparatus of the present invention, the rotary switch 12 is rotated to be converted from an off state to an on state.

As described above, when the rotary switch 12 is converted from the off state to the on state, electrical energy of the batteries 100 mounted to the battery receiving unit 11 is supplied to the driving motor 13.

As the driving motor 13 to which the electrical energy has been supplied as described above is driven, rotational power generated by drive of the driving motor 13 is transferred to the driving member 16 of the actuating unit 15 connected to the rotary shaft 14 to operate the driven member 17, and the driven member 17 is operated in conjunction with the driving member 16 such that the tapping member 21 installed in the driven member 17 reciprocates forward and rearward.

As described above, when the tapping member 21 reciprocates forward and rearward, the stimulus bosses 22*a* of the tapping head 22 constituting the tapping member 21 sufficiently apply physical stimuli to the skin to help a muscle be relaxed and to activate metabolism, thereby maintaining the skin elastic and healthy, An actuating state of the actuating unit 15 which reciprocates the tapping member 21 to massage the skin will be described for the exemplary embodiments.

As described above, in the actuating unit 15 shown in FIGS. 1 and 2, when the rotary switch 12 is converted from the off state to the on state such that the driving motor 13 is rotated by the electrical energy of the batteries 100, the inclined surface 16*c* of the driving member 16 in surface-contact with the inclined surface 17*c* of the driven member 17 as shown in FIG. 1 is continuously and repeatedly located as shown in FIG. 2 such that the tapping member 21 installed in the driven member 17 moves forward and the driven member 17 is moved rearward by the repulsive force of the repulsive spring 23 compressed by the forward movement of the tapping member 21, thereby continuously reciprocating the tapping member 21.

As the tapping member 21 reciprocates as described above, the stimulus bosses 22*a* of the tapping head 22 constituting the tapping member 21 may apply physical stimuli to the skin to maintain the skin healthy.

Figure 3:
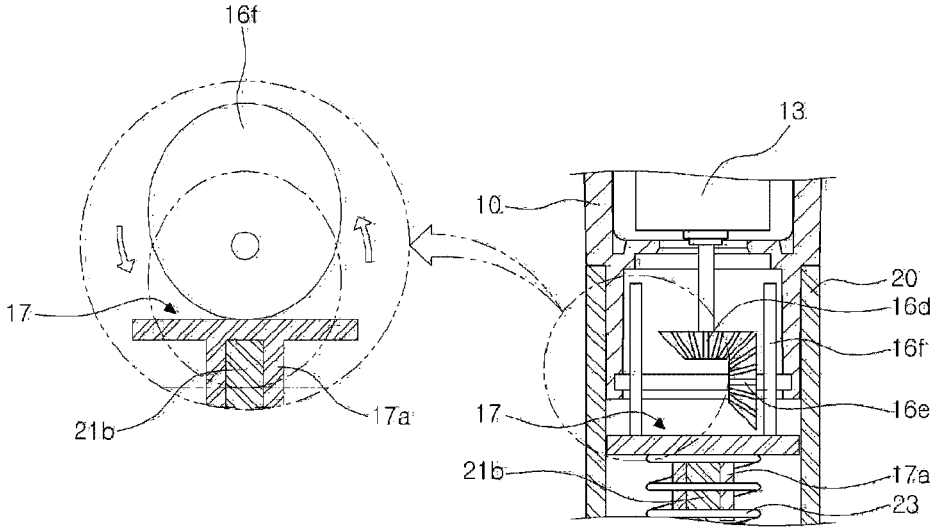
FIG. 3 is a schematic sectional view showing another exemplary embodiment of the present invention.
Figure 4:
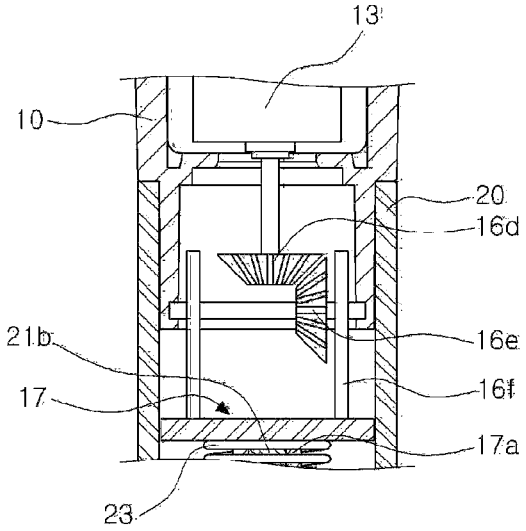
FIG. 4 is an exemplary view showing a state where a tapping member is operated by an actuating unit in a state of FIG. 3.

In another embodiment of the actuating unit shown in FIGS. 3 and 4, when the rotary switch 12 is converted from the off state to the on state such that the driving motor 13 is rotated by the electrical energy of the batteries 100, the driving bevel gear 16*d* constituting the driving member 16 is operated in conjunction with the driving motor 13, and the driven bevel gear 16*e* engaged with the driving bevel gear 16*d* is operated in conjunction with the driving bevel gear 16*d*.

When the driven bevel gear 16*e* is operated as described above, the cam 16*f* installed on the same shaft as the driven bevel gear 16*e* is operated in conjunction with the driven bevel gear 16*e* such that the cam 16*f* in a state of FIG. 3 is located as shown in FIG. 4 to move the driven member 17.

As the driven member 17 is moved as described above, the tapping member 21 installed in the connecting pipe 17*a* through the connecting rod 21*b* moves forward, and the driven member 17 is moved rearward by the repulsive force of the repulsive spring 23 compressed by the forward movement of the tapping member 21, continuously reciprocating the tapping member 21.

As the tapping member 21 reciprocates as described above, the stimulus bosses 22*a* of the tapping head 22 constituting the tapping member 21 may apply physical stimuli to the skin to maintain the skin healthy.

Figure 5:
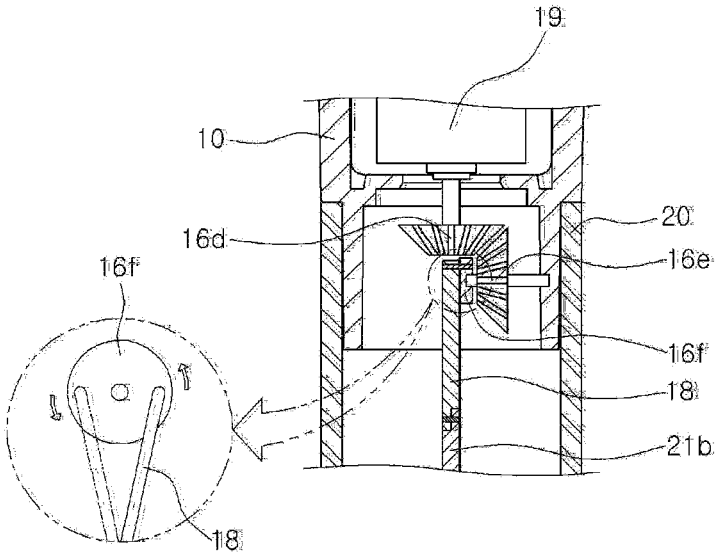
FIG. 5 is a schematic sectional view showing another exemplary embodiment of the present invention.
Figure 6:
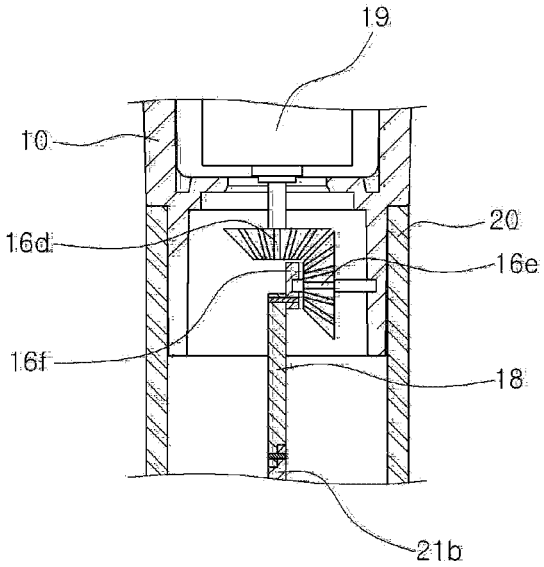
FIG. 6 is an exemplary view showing a state where a tapping member is operated by an actuating unit in a state of FIG. 5

In another embodiment of the actuating unit shown in FIGS. 5 and 6, when the rotary switch 12 is converted from the off state to the on state such that the driving motor 13 is rotated by the electrical energy of the batteries 100, the driving bevel gear 16*d* constituting the driving member 16 is operated in conjunction with the driving motor 13, and the driven bevel gear 16*e* engaged with the driving bevel gear 16*d* is operated in conjunction with the driving bevel gear 16*d*.

When the driven bevel gear 16*e* is operated as described above, the cam 16*f* installed on the same shaft as the driven bevel gear 16*e* is operated in conjunction with the driven bevel gear 16*e* such that the cam 16*f* in a state of FIG. 5 is located as shown in FIG. 6 to move the crank rod 18 corresponding to the driven member.

One end of the crank rod 18 operated in conjunction with the cam 16*f* as described above is hingedly connected to the cam 16*f*, and an opposite end of the crank rod 18 is hingedly connected to the connecting rod 21*b* of the tapping member 21, thereby enabling the tapping member 21 to continuously reciprocate.

As the tapping member 21 reciprocates as described above, the stimulus bosses 22*a* of the tapping head 22 constituting the tapping member 21 may apply physical stimuli to the skin to maintain the skin healthy.

In another embodiment of the actuating unit shown in FIGS. 7 and 8, when the rotary switch 12 is converted from the off state to the on state such that the driving motor 13 is rotated by the electrical energy of the batteries 100, the guide bosses 17*d* of the driven member 17 located at an upper portion of the helical groove 16*g* of the driving member 16 as shown in FIG. 7 are located at a lower portion of the helical groove 16*g* as shown in FIG. 8 such that the tapping member 21 in which the connecting rod 21*b* is connected to the connecting pipe 17*a* moves forward.

At this time, the reason why the driven member 17 is moved forward without any rotation is because the guide bosses 17*d* of the driven member 17 is guided by the vertical guide hole 16*h*' of the guide pipe 16*h* fixed to the second case 20.

In a state where the tapping member 21 moves forward as described above, the driving motor 13 is driven in a reverse direction such that the tapping member 21 continuously reciprocates.

As the tapping member 21 reciprocates as described above, the stimulus bosses 22*a* of the tapping head 22 configuring the tapping member 21 may apply physical stimuli to the skin to maintain the skin healthy.

In another embodiment of the actuating unit shown in FIGS. 9 and 10, the connecting rod 21*b* is directly connected to the piston rod of the solenoid such that the tapping member 21 is reciprocated forward and rearward by the solenoid 19.

While the solenoid 19 to which the tapping member 21 is connected reciprocates forward and rearward by a stroke distance of the piston rod, the stimulus bosses 22*a* of the tapping head 22 may apply physical stimuli to the skin to maintain the skin healthy.

What is claimed is:

1. A skin massager comprising:

a first body comprising a switch unit, the first body enclosing a motor, and a battery unit, the motor having a rotary shaft attached to the motor and a second body comprising a rotating member, a reciprocating member, and a tapping member, the first body being attached on the second body to form a generally cylindrical body, the rotating member having a connection portion including a first aperture extended upwardly to directly receive the rotary shaft, the rotating member having a second connection portion including a second aperture extended downwardly to engage with the reciprocating member wherein a spiral groove is formed at an inner peripheral surface of the second portion, the reciprocating member having a hole formed at a lower surface of the reciprocating member to engage with the tapping member for massaging, the reciprocating member having a guide protrusion formed at an outer side peripheral surface of the reciprocating member to engage with the spiral groove of the second portion of the rotating member, so that when the massager is on, during use, the rotating member continuously rotates within an inner peripheral surface of the second body while allowing the reciprocating member to continuously vertically reciprocate within an inner surface of the rotating member, the second body having a vertical guide on the inner peripheral surface of the second body wherein the guide protrusion of the reciprocating member is guided to vertically reciprocate within the vertical guide while the guide protrusion of the reciprocating member is engaged with the spiral groove of the second portion of the rotating member, so that the reciprocating member is prevented from being rotated along the rotating member.

* * * * *